US005375817A

United States Patent [19]

Bleijendaal et al.

[11] Patent Number: 5,375,817

[45] Date of Patent: Dec. 27, 1994

[54] HOT BLAST STOVE AND METHOD FOR CONSTRUCTING A HOT BLAST STOVE

[75] Inventors: Nicolaas G. J. Bleijendaal, Akersloot; August H. Hendriks, Koog aan de Zaan; Jacobus van Laar, Driehuis; Ronald J. M. Stokman, Hillegom, all of Netherlands

[73] Assignee: Hoogovens Groep B.V., Ijmuiden, Netherlands

[21] Appl. No.: 181,452

[22] Filed: Jan. 14, 1994

Related U.S. Application Data

[63] Continuation of Ser. No. 7,972, Jan. 11, 1993, abandoned.

[30] Foreign Application Priority Data

Jan. 24, 1992 [NL] Netherlands ..... 9200134

[51] Int. Cl.[5] ..... F28F 21/04; F27D 1/06

[52] U.S. Cl. ..... 266/44; 264/30; 266/139; 266/280; 266/285; 432/217

[58] Field of Search ..... 266/139, 280, 281, 285, 266/286, 44; 264/30; 432/217, 247, 248, 251

[56] References Cited

U.S. PATENT DOCUMENTS

| | | | |
|---|---|---|---|
| 2,035,309 | 3/1936 | Fitch | 263/51 |
| 2,903,778 | 9/1959 | Gibson et al. | 25/155.5 |
| 3,048,481 | 8/1962 | Eastman | 266/281 |
| 4,221,537 | 9/1980 | Mamula et al. | 266/281 |
| 4,369,954 | 1/1983 | Palz | 266/139 |
| 4,508,504 | 4/1985 | Eschmann et al. | 432/217 |

FOREIGN PATENT DOCUMENTS

| | | |
|---|---|---|
| 2426093 | 12/1975 | Germany . |
| 3609893 | 9/1986 | Germany . |
| 1494666 | 12/1977 | United Kingdom . |
| 2032599 | 5/1980 | United Kingdom . |
| 2172982 | 10/1986 | United Kingdom . |

OTHER PUBLICATIONS

"Bouweise und Betriebs-ergenbnisse von Hochtemperaturwinderhitzern", 110 Stahl u. Eisen, Vol. 95,8/(1975), nr 17, 14. August Seiten 802–806.

Blz 97,98 van 2356 Metallurgist, vol. 23, No. 1/2, (1979,01/02).

*Primary Examiner*—Scott Kastler

*Attorney, Agent, or Firm*—Stevens, Davis, Miller & Mosher

[57] ABSTRACT

In the construction of a hot blast stove, walls are made of pre-formed and baked bricks. At the joint between two walls, cast joining elements of complex shape are incorporated. The cast joining elements may be cast in situ. This avoids the need for pressing joining bricks of a variety of shapes.

5 Claims, 2 Drawing Sheets

PRIOR ART

HOT BLAST STOVE AND METHOD FOR CONSTRUCTING A HOT BLAST STOVE

This application is a Continuation Application of application Ser. No. 08/007,972, filed Jan. 11, 1993, now abandoned.

BACKGROUND OF THE INVENTION

1 . Field of the Invention

The invention relates to a hot blast stove having a refractory structure of two or more walls consisting mainly of bricks, which walls are joined together with joining elements connecting into them, and to a method for constructing such a hot blast stove.

2. Description of the Prior Art

Hot blast stoves are well known and are used for heating the air blown into a blast furnace. One known form of hot blast stove consists of a surrounding wall within which there is a combustion shaft and a checker work shaft, which shafts are separated by a partition wall joined to the surrounding wall on both sides by means of joining elements. In the case of this known hot blast stove the bricks and the joining elements are preformed, pressed and burned bricks. These joining elements in the form of bricks frequently have a complex shape and serve to provide the various connections, for example between the surrounding wall and the partition wall. Because the walls are erected in a brickwork bond, the joining bricks also have differing shapes for differing courses of which the wall is composed. For constructing the known hot blast stove the joining bricks are made in advance by pressing them in specifically designed heavy press molds. The variation arising in shape of the different joining bricks necessitates corresponding variation of press molds which causes considerable costs. FIGS. 1A, 1B and 1C of the accompanying drawings serve to illustrate that different joining bricks are used in one hot blast stove; in practice the number is greater than 35, and so the same number of differing press molds are needed for making them. In addition, the shaping possibilities and the shape of the prefabricated joining bricks which have to be fitted so that they link well into the brickwork limit design and construction possibilities of the known hot blast stove.

Constructions and brickwork of hot blast stoves are illustrated in articles Stahl und Eisen Vol. 95 (1975) No. 17, pages 802–806 and Metallurgist, Vol 23, no. 1/2 (1979), pages 97, 98.

SUMMARY OF THE INVENTION

The object of the invention is to provide a hot blast stove and a method for its construction, in which the drawbacks mentioned above are removed. In particular the invention has the object of providing a method by which the need for large numbers of heavy press molds is avoided.

According to the invention in its method aspect, there is provided a method for constructing a hot blast stove having two refractory walls joined to each other at a joint, said method comprising building the two walls mainly of bricks and incorporating at least one cast joining element at the joint of the walls.

Preferably in a plurality of courses and/or layers of the bricks of the walls, cast joining elements are used at the wall joint. The cast joining elements may be preformed before incorporation in the walls, in which case they may be made in relatively light and simple molds and do not require baking. Alternatively the cast joining element or elements are cast in situ at their locations in the wall joint. This has the advantage that pre-forming in separate molds is not required, and the need to use a large number of different molds is avoided. Instead some shuttering may be required to form simple temporary molds at the locations of the cast joining elements in the walls.

In its second aspect, the invention provides a hot blast stove having refractory walls constructed mainly of bricks and joined to each other at a joint including at least one joining element, preferably of refractory concrete. Preferably the hot blast stove has a plurality of the cast joining elements which have been cast in situ during construction of the hot blast stove.

The invention thus achieves the effect that the technique of pressing joining bricks in the heavy press molds designed for that purpose may be dispensed with and replaced by the much less expensive technique of casting, preferably on site, into light casting molds. In addition to dispensing with pressing of joining bricks in the press molds, casting in situ produces the effect that the joining elements always connect perfectly despite the particularly complicated shapes which can occur at the joints. By casting the joining elements in situ during construction, and thereby making their prefabrication superfluous, it has been found possible to achieve a cost reduction of over 5% of the total cost of the refractory structure.

When casting in situ, typically the joining element is cast into a space defined at least partially by said bricks of the adjoining walls and this space is usually defined partially by at least one shuttering member. This ensures proper connection into the laid bricks because the laid bricks form a part of the casting mold, while further bordering of the casting mold may be achieved with one or more shuttering parts which themselves may be reused as erection work of the structure proceeds.

In a preferred method in accordance with the invention, before the joining element is cast, spacing means for an expansion joint is fitted between the location of the joining element and at least one brick of at least one of the walls. This achieves the effect that expansion of the surrounding bricks and the joining elements is made possible, which is important in connection with the varying thermal loading during operation of a hot blast stove. Preferably the spacing means is a material which disintegrates due to heat on operation of the stove, e.g. a plastics material such as expanded polystyrene, or is a compressible material such as felt. Depending on the properties and the thickness of the spacing layer, this makes it possible to take suitable account of the expansion occurring during operation.

BRIEF INTRODUCTION OF THE DRAWINGS

Embodiments of the invention will now be described by way of non-limitative example with reference to the accompanying drawings, in which:

FIG. 1A-1 is an enlargement of the detail A of FIG. 1A;

FIG. 1B is a horizontal cross-sectional view of the same stove at a middle region thereof and FIG. 1B-1 is an enlargement of detail B of FIG. 1B;

FIG. 1C and 1C-1 are likewise a horizontal cross-sectional view and enlarged detail of the same stove at a lower region; and FIGS. 2A, 2A-1, 2B, 2B-1, 2C and 2C-1 are cross sectional views and enlargements, corresponding to the views of FIGS. 1A, 1A-1, 1B, 1B-1, 1C and 1C-1, of a hot blast stove embodying the invention.

DESCRIPTION OF THE PREFERRED EMBODIMENTS

Figure 1A:
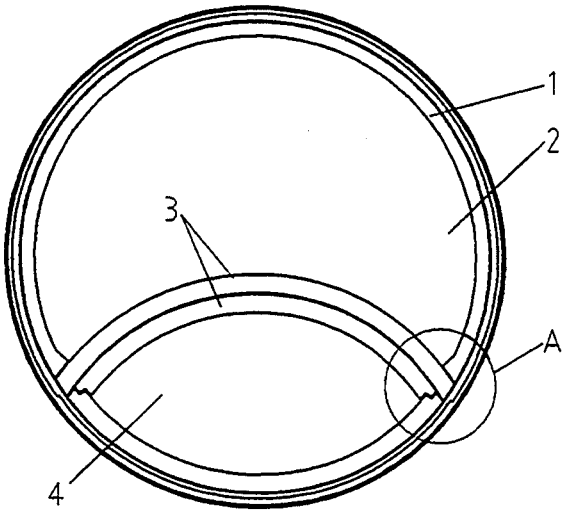
FIG. 1A is a horizontal cross-sectional view of a known hot blast stove at an upper region of the stove.
Figures 1, 1A:
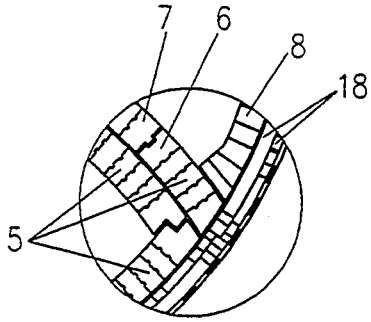
Figures 1, 1B:
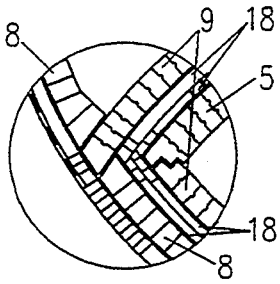
Figure 1B:
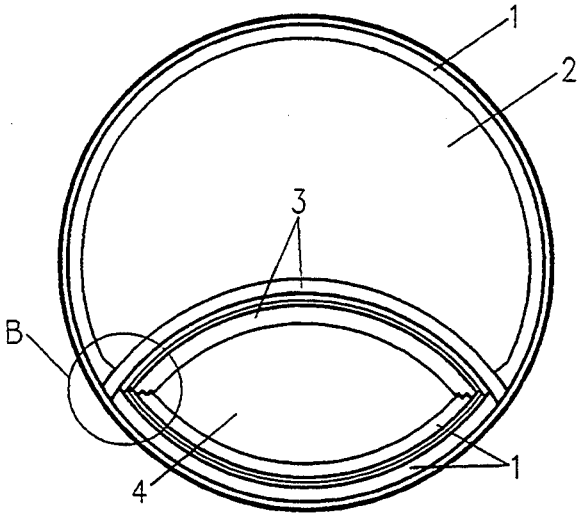
Figure 1C:
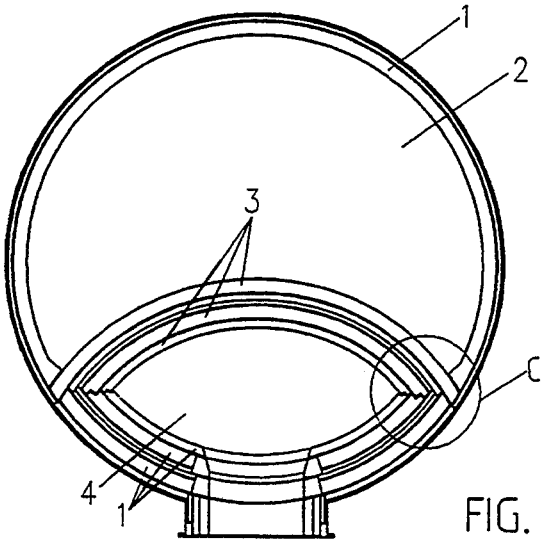
Figures 1, 1C:
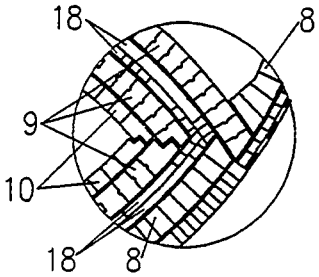

FIGS. 1A, 1B and 1C show cylindrical surrounding wall 1 of the hot blast stove, within which there is a partition wall 3 separating the checkerwork shaft 2 from the burner shaft 4. The partition wall 3 is joined at each end of the surrounding wall at a wall joint. Known details of the hot blast stove, not affected by the present invention, need not be discussed here. As the detail views of FIGS. 1A-1, 1B-1 and 1C-1 show, the walls 1, 3 have layers of pre-pressed and baked bricks 5, 6, 7, 8, 9, 10. At the lower region shown in FIGS. 1C and 1C-1, the burner shaft 4 is provided with additional wall layers of pre-pressed and baked bricks 8, 9, 10. An additional intermediate layer 18 may also be present.

FIGS. 1A-1, 1B-1 and 1C-1 show that at the wall joints, each of the joining bricks, i.e. the bricks which essentially form parts of both walls, has its own particular shape determined by its location, so that a wide variety of joining bricks is required. The present invention is applicable to such walls or wall layers mainly or substantially entirely formed of bricks.

Figure 2A:
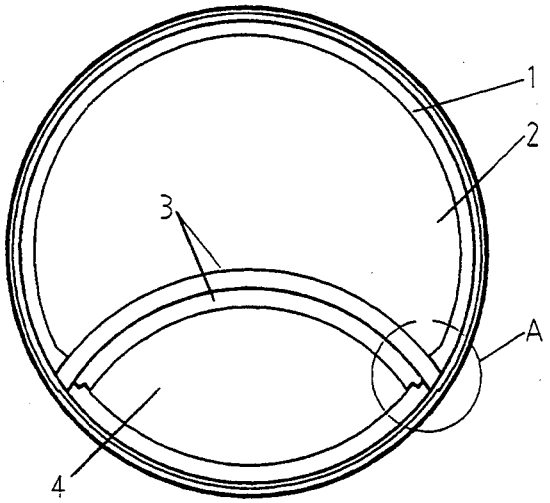
Figures 1, 2A:
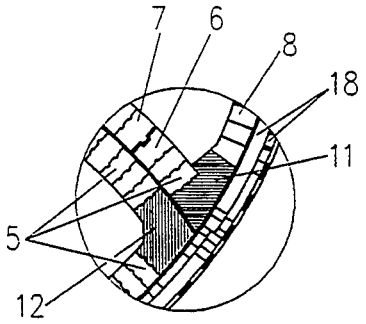
Figures 1, 2B:
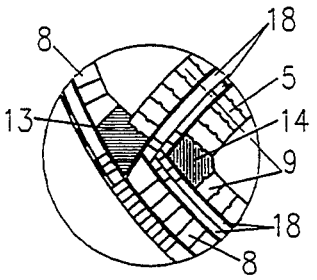
Figure 2B:
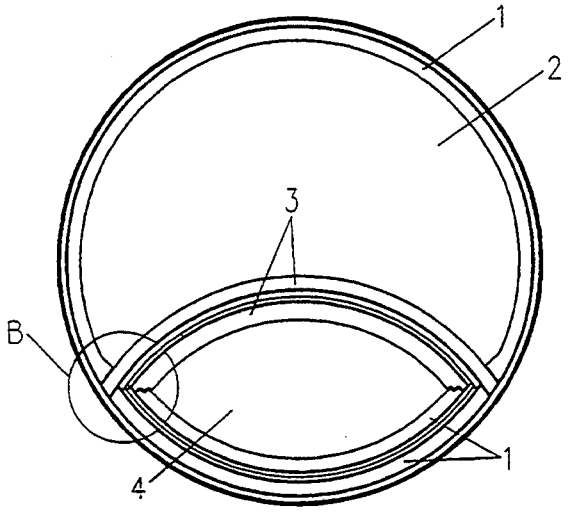
Figure 2C:
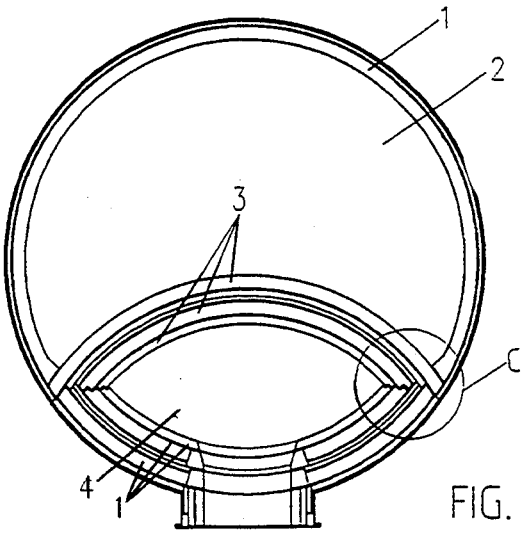
Figures 1, 2C:
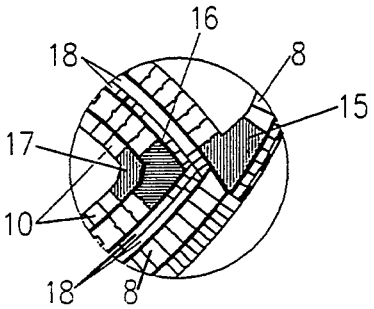

The corresponding views of FIGS. 2A, 2A-1, 2B, 2B-1 2C and 2C-1 of the hot blast stove embodying the invention show that the pre-pressed and baked joining bricks are replaced by cast joining elements 11, 12, 13, 14, 15, 16, 17, made of castable refractory concrete. As shown in the horizontal sections, there is a cast joining element corresponding to each pair of joined layers of bricks Thus in FIG. 2A-1 the walls 1, 3 are joined by the cast joining element 11, 12 of different shapes. In FIG. 2B-1, the walls 1, 3 are joined by the cast joining element 13, 14. In FIG. 2C-1, the walls 1, 3 are joined by the cast joining elements 15, 16, 17.

The height of each of the cast joining elements 11–17 may typically be the same as that of one course of the adjoining bricks, or two courses of the adjoining bricks. In practice, both have been found suitable.

The illustrated hot blast stove embodying the invention is otherwise generally the same as that of FIGS. 1A, 1A-1 etc.

In one method embodying the invention of constructing the hot blast stove of FIGS. 2A, 2A-1 etc., the cast joining elements were made using separate casting molds in the immediate vicinity of the construction site. In another method of the invention, the joining elements were cast in situ, as described below. The choice of method depends on stove dimensions, local circumstances, accessibility, flow properties of the castable material etc.

In the method of in situ casting of the cast joining elements, when one of the courses of the walls is being constructed, a spacer material such as felt for example is placed on the boundaries of the laid bricks and a shuttering part is placed at the boundary of the desired joining element which is not bordered by laid bricks, thus forming a casting mold for the joining element. Then liquid concrete is poured up to the desired level.

A joining element of very complicated shape is thus formed in situ. The joining element may extend in height over one or more courses of the walls 1 and 3. The felt forms expansion joints in the structure. In the case of the structure of the hot blast stove in accordance with the invention it is possible to concentrate the expansion locations for expansion of the partition wall 3 at the boundary faces of the joining elements.

In the invention, there is deviation from the previous notion that for the joining elements, bricks have to be used that are preformed, pressed and burned and subjected to strict requirements, and a new method is opened up by which construction is considerably simplified and the costs are reduced as a result.

Suitable castable materials for the cast joining elements are commercially available low cement high alumina castables.

What is claimed is:

1. A method for constructing a hot blast stove consisting of a surrounding refractory wall within which there is a combustion shaft and a checkerwork shaft which shafts are separated by a partition refractory wall joined to the surrounding wall at a joint by means of joining elements, said method comprising the steps of:
   a) building said two walls mainly of reformed, pressed and burned bricks;
   b) casting of at least one joining element of a castable refractory concrete for incorporation at said joining; and
   c) positioning spacing means for an expansion joint between said cast joining element and at least one brick of at least one said wall.

2. The method of claim 1, wherein said spacing means is selected from a plastics material which is removed by heat on operation of the stove and felt.

3. The method of claim 1 wherein said cast joining element is formed in situ at said joint of the walls during the building of the walls by casting into a space defined at least partially by said bricks of adjoining walls.

4. The method of claim 3, wherein the joining element is cast into a space defined partially by at least one shuttering member.

5. A method for constructing a hot blast stove having two refractory walls joined to each other at a joint, said method comprising the steps of:
   a) building said two walls substantially of pre-shaped bricks,
   b) during said building step arranging at said joint spaces free of said bricks and surrounded by faces of said bricks and shuttering means, said spaces thus forming casting mold
   c) casting refractory concrete into said spaces forming casting mold to form in situ cast concrete joining elements joining said walls together at said joint.

* * * * *